US007393227B2

(12) United States Patent
Scholeno et al.

(10) Patent No.: US 7,393,227 B2
(45) Date of Patent: Jul. 1, 2008

(54) LAMPHOLDER FOR DOUBLE-ENDED LAMP

(76) Inventors: Michael F. Scholeno, 1679 Westgate Dr., #103, York, PA (US) 17408; Shane Brown, 1070 Gora Rd., York, PA (US) 17404; Jack Burwick, 465 Quaker Rd., York, PA (US) 17402

( * ) Notice: Subject to any disclaimer, the term of this patent is extended or adjusted under 35 U.S.C. 154(b) by 0 days.

(21) Appl. No.: 11/544,967

(22) Filed: Oct. 6, 2006

(65) Prior Publication Data

US 2008/0085623 A1 Apr. 10, 2008

(51) Int. Cl.
*H01R 33/08* (2006.01)

(52) U.S. Cl. ..... 439/243; 439/244; 439/248; 439/700

(58) Field of Classification Search ..... 439/375, 439/225, 243, 247, 248, 700, 242, 226, 244
See application file for complete search history.

(56) References Cited

U.S. PATENT DOCUMENTS 2,716,739 A * 8/1955 Lemmers ..... 439/244
2,722,666 A * 11/1955 Hodgkins ..... 439/244
3,060,310 A * 10/1962 Bertsche, Jr. et al. ..... 362/221
3,327,281 A * 6/1967 Johnson ..... 439/230
3,353,140 A * 11/1967 Johnson ..... 439/237
4,842,535 A * 6/1989 Velke et al. ..... 439/232
4,868,727 A * 9/1989 Ponds et al. ..... 362/344
5,109,323 A * 4/1992 Waycaster ..... 362/217
5,122,074 A * 6/1992 Maag et al. ..... 439/237
5,510,964 A * 4/1996 Spitler et al. ..... 362/217
5,569,042 A * 10/1996 Mosebach ..... 439/237

* cited by examiner

*Primary Examiner*—Renee Luebke
*Assistant Examiner*—Harshad C Patel

(57) ABSTRACT

A socket (10) for a double-ended lamp has a housing (12); a compression spring (14) within the housing (12); a lamp connector (16) comprising a body (18) with a first portion (20) contained entirely within the housing (12) and a second portion (22) extending beyond the housing (12) and having a given length L, the lamp connector (16) being subjected to an axial movement when a lamp is operatively positioned with the socket (10), the axial movement having a maximum distance AL that is less than the given length L.

3 Claims, 1 Drawing Sheet

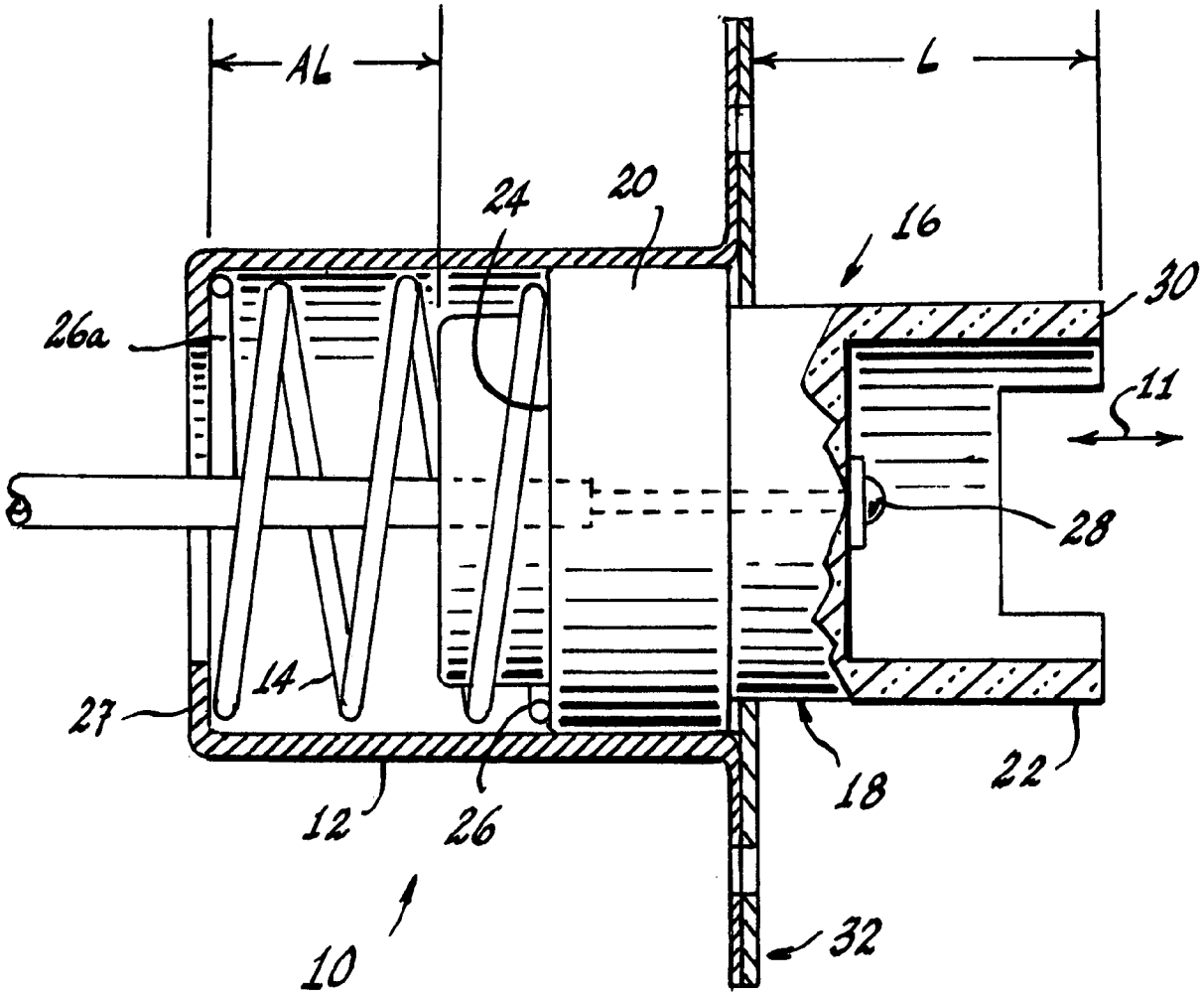
30
11
28
22
L
16
18
32
20
24
26
AL
12
10
14
26a
27

LAMPHOLDER FOR DOUBLE-ENDED LAMP

TECHNICAL FIELD

This invention relates to lampholders and particularly to lampholders for double-ended lamps. Still more particularly, it relates to lampholders (e.g., sockets) for double-ended lamps that have more efficient operation.

BACKGROUND ART

Lampholders for some double-ended lamps have comprised a metal housing containing a slidable ceramic body therein. A portion of the ceramic body extends from both ends of the housing and one end of the body is formed to receive, hold, and supply electrical power to an inserted lamp. It was often the case, when inserting a lamp, that the lamp-receiving portion of the body would penetrate the housing to too great an extent and become wedged in the housing. This problem created considerable downtime when changing lamps and resulted in extra costs associated with the lamp replacement.

DISCLOSURE OF INVENTION

It is, therefore, an object of the invention to obviate the disadvantages of the prior art.

It is another object of the invention to enhance sockets for double-ended lamps.

These objects are accomplished, in one aspect of the invention, by a socket for a double-ended lamp that comprises a housing, a compression spring within the housing; a lamp connector comprising a body with a first portion contained entirely within the housing and a second portion extending beyond the housing and having a given length L, the lamp connector being subjected to an axial movement when a lamp is operatively positioned with the socket, the axial movement having a maximum distance that is less than the given length.

BRIEF DESCRIPTION OF THE DRAWINGS

The single FIGURE is an elevational view, partially in section, of an embodiment of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Referring now to the drawing with greater particularity, there is shown a socket 10 for a double-ended lamp (not shown) that comprises a housing 12 having a compression spring 14 within the housing 12. The housing 12 can be constructed of a suitable metal.

A lamp connector 16 has a body 18 of a suitable electrically insulating material, such as a ceramic, is fitted within the housing 12. A first portion 20 of the body 18 is contained entirely within the housing 12 and a second portion 22 extends beyond the housing 12 and has a given length L. The lamp connector 16 is subjected to an axial movement (see arrow 11) whenever a lamp is inserted or withdrawn. The axial movement has a maximum distance AL that is less than the given length L, thus preventing the leading edge 30 of the second portion 22 from being constrained within the housing.

The first portion 20 of the body 18 includes a flange 24 that is in contact with a first end 26 of the compression spring 14. The other end **26*a* of the compression spring 14 is held against a housing flange 27**.

An electrically conductive lamp contact 28 is fixed in the body 18, as is known.

For mounting purposes a mounting bracket 32 is provided affixed to the housing 12.

Thus there is provided a new and improved socket for double-ended lamps. The socket is smaller and less cumbersome than those of the prior art and additionally makes jamming of the lamp-receiving portion of the connector body within the housing an impossibility.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A socket for a double-ended lamp comprising:

a housing;

a compression spring within said housing;

a lamp connector comprising a body with a first portion contained entirely within said housing and a second portion extending beyond said housing and having a given length L, said first portion including a flange in contact with an end of said compression spring, said lamp connector being subjected to an axial movement when a lamp is operatively positioned with said socket, said axial movement having a maximum distance AL that is less than said given length L.

2. The socket of claim 1 wherein said body is electrically insulating and contains mounted therein an electrically conductive lamp contact.

3. The socket of claim 1 wherein said housing includes a mounting bracket.

* * * * *